US008350453B2

(12) United States Patent
Tran et al.

(10) Patent No.: US 8,350,453 B2
(45) Date of Patent: Jan. 8, 2013

(54) LAMP COVER INCLUDING A PHOSPHOR MIXED STRUCTURE FOR LIGHT EMITTING DEVICE

(75) Inventors: Nguyen The Tran, Garden Grove, CA (US); Yongzhi He, Irvine, CA (US); Frank Shi, Irvine, CA (US)

(73) Assignee: Nepes LED Corporation, Chungcheongbuk-do (KR)

( * ) Notice: Subject to any disclaimer, the term of this patent is extended or adjusted under 35 U.S.C. 154(b) by 0 days.

(21) Appl. No.: 12/786,449

(22) Filed: May 25, 2010

(65) Prior Publication Data

US 2011/0291548 A1 Dec. 1, 2011

(51) Int. Cl.

| | |
|---|---|
| ***H01J 5/16*** | (2006.01) |
| ***H01J 61/40*** | (2006.01) |
| ***H01K 1/26*** | (2006.01) |
| ***H01K 1/30*** | (2006.01) |

(52) U.S. Cl. ..... 313/112; 313/501; 313/113; 257/98

(58) Field of Classification Search ..... 313/503, 313/112, 502, 113, 114; 257/98; 362/8, 362/331, 327, 231, 318, 84

See application file for complete search history.

(56) References Cited

U.S. PATENT DOCUMENTS

| | | | | |
|---|---|---|---|---|
| 7,828,453 | B2 * | 11/2010 | Tran et al. | 362/84 |
| 7,972,023 | B2 * | 7/2011 | Tran et al. | 362/84 |
| 2005/0093430 | A1 * | 5/2005 | Ibbetson et al. | 313/501 |
| 2007/0132366 | A1 * | 6/2007 | Yabe et al. | 313/501 |
| 2007/0182299 | A1 * | 8/2007 | Ouderkirk et al. | 313/110 |
| 2008/0068821 | A1 * | 3/2008 | Wang et al. | 362/84 |
| 2008/0111145 | A1 * | 5/2008 | Lin | 257/98 |
| 2009/0001399 | A1 * | 1/2009 | Diana et al. | 257/98 |
| 2009/0026485 | A1 * | 1/2009 | Urano et al. | 257/99 |
| 2009/0095967 | A1 * | 4/2009 | Masui et al. | 257/98 |
| 2009/0278147 | A1 * | 11/2009 | Suzuki | 257/98 |
| 2009/0295265 | A1 * | 12/2009 | Tabuchi et al. | 313/112 |
| 2010/0328925 | A1 * | 12/2010 | Hoelen et al. | 362/84 |
| 2010/0328926 | A1 * | 12/2010 | Hoelen et al. | 362/84 |
| 2011/0025192 | A1 * | 2/2011 | Ansems et al. | 313/501 |

FOREIGN PATENT DOCUMENTS

| | | | |
|---|---|---|---|
| WO | WO 2005067064 | A1 * | 7/2005 |
| WO | WO 2009093163 | A2 * | 7/2009 |
| WO | WO 2009107052 | A1 * | 9/2009 |

* cited by examiner

*Primary Examiner* — Mariceli Santiago
*Assistant Examiner* — Glenn Zimmerman
(74) *Attorney, Agent, or Firm* — Ladas & Parry LLP

(57) ABSTRACT

A lamp cover containing phosphor for providing white light emission is disclosed. The lamp cover is comprised of a light-partial-reflective cap structure providing the outer surface of the lamp cover, wherein the light-partial-reflective cap structure is composed of a plurality of light transparent layers and a plurality of vacuum layers that are stacked in an alternating manner from outside to inside, a supporting transparent cap structure providing the inner surface of the lamp cover, and a phosphor mixed structure mechanically supported by the outer surface of the supporting transparent cap structure, wherein the outer surface of the phosphor mixed structure is adjacent to the most inner vacuum layer of the light-partial-reflective cap structure. Once the lamp cover is combined with a phosphor exciting light source, the light-partial-reflective cap structure partially prevents phosphor exciting light from escaping from the lamp cover by using Fresnel reflection.

14 Claims, 2 Drawing Sheets

LAMP COVER INCLUDING A PHOSPHOR MIXED STRUCTURE FOR LIGHT EMITTING DEVICE

BACKGROUND

1. Field

Example embodiments of inventive concepts relate to a lamp cover for light emitting device.

2. Description of the Related Art

Combining the uses of blue LEDs and blue excited phosphor is a popular technology to produce white light emission. In such a technology, the blue light hits the phosphor and is partially converted into a longer wavelength, such as a yellow one. The excited light portion mixed with the residual blue light produces a pseudo white light.

A common method to implement such a white light emitting device is to mix phosphor with a liquid resin binder and dispense the phosphor mixed resin binder around the LED chip. The main disadvantage of this method is that it is hard to get a uniform color distribution at different angles since the light path length at different angles cannot be easily controlled to be the same. Meantime, the displacement of LED dies during die bonding process make the uniform color control more difficult.

To get a more uniform color distribution, a method to use a pre-made phosphor structure with the same thickness at all position is proposed in U.S. Pat. No. 7,582,914. In such a method, the pre-made phosphor structure is placed far away from the LED chip. In many cases, it is separated from the blue LED package and attached onto the PCB, where the blue LED package is located. Since the phosphor structure is far away from the LED chip and the leadframe house cavity where the LED chip is located, the scattering effect of the phosphor particles is much less than that in the phosphor-near-chip case so that blue light can easily escape without being absorbed to emit fluorescent light. As a result, phosphor usage and weight percentage should be greatly increased to make the phosphor structure for achieving the same correlated color temperature of light emission in comparison to the phosphor-near-chip case. The bigger the distance between the phosphor structure and the LED chip is, the more phosphor usage is needed, which dramatically increases the cost of lumen per watt for white LED lighting system since the current commercial phosphor prices are very expensive.

As for general lighting, a pre-made phosphor structure with a big dimension or large area is highly desired since it not only provides a uniform light distribution, but also reduces the LED flickering issue, which has been complained by customers for long time.

SUMMARY OF INVENTION

A lamp cover for a light emitting device is provided, the lamp cover comprising: an outer surface of the lamp cover; a supporting transparent cap structure providing an inner surface of the lamp cover; a phosphor mixed structure supported by the supporting transparent cap structure; and a light-partial-reflective cap structure disposed between the outer surface and the phosphor mixed structure, wherein the light-partial-reflective cap structure comprises at least one light transparent material layer and at least one space layer that are stacked in an alternating manner.

At least one interface between the at least one transparent material layer and the at least one space layer may serve as a light-partial-reflective surface by using Fresnel reflection.

The at least one interface may be coated with an anti-reflection layer for fluorescent light emitting from the phosphor mixed structure to prevent the fluorescent light from being reflected back into the phosphor mixed structure.

An outer surface of the phosphor mixed structure may be adjacent to the most inner space layer of the light-partial-reflective cap structure.

The most inner space layer of the light-partial-reflective cap structure may be a vacuum in order to protect the phosphor mixed structure by preventing it from being oxidized, and the other space layers may be air-filled layers when the light-partial-reflective cap structure comprises a plurality of the space layers.

The number of the pair of transparent material layer and space layer may be only one.

A light emitting device is provided, the light emitting device comprising: a substrate; a LED package mounted on the substrate; and a lamp cover disposed on the substrate to surround the LED package, wherein the lamp cover comprises: an outer surface of the lamp cover; a supporting transparent cap structure providing an inner surface of the lamp cover; a phosphor mixed structure supported by the supporting transparent cap structure; and a light-partial-reflective cap structure disposed between the outer surface and the phosphor mixed structure, wherein the light-partial-reflective cap structure comprises at least one light transparent material layer and at least one space layer that are stacked in an alternating manner.

The LED package may emit a blue light ray or an UV light ray.

For example, the substrate may be a PCB.

The lamp cover can be combined with UV/Blue LEDs to generate white light emission.

BRIEF DESCRIPTION OF THE DRAWINGS

Example embodiments of inventive concepts will be more clearly understood from the following detailed description taken in conjunction with the accompanying drawings. FIGS. 1-2B represent non-limiting, example embodiments of inventive concepts as described herein.

FIG. 1 is a schematic cross-sectional view of the lamp cover according to example embodiments of inventive concepts.

FIG. 2B is a magnified view of FIG. 2A for a clearer illustration.

DETAILED DESCRIPTION OF THE INVENTION

Figure 1:
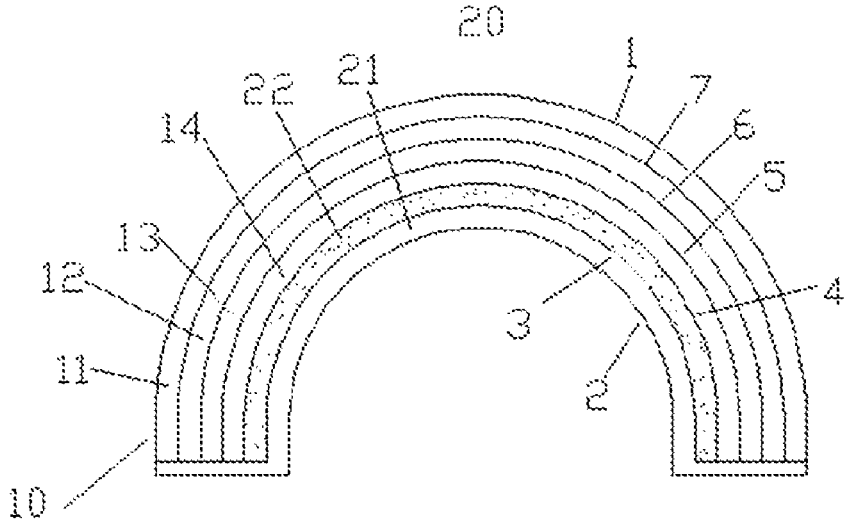

Example embodiments of inventive concepts will now be described more fully with reference to the accompanying drawings, in which example embodiments of inventive concepts are shown. The invention may, however, be embodied in different forms and should not be construed as limited to the embodiments set forth herein. Rather, example embodiments of inventive concepts are provided so that this disclosure will be thorough and complete, and will fully convey the scope of the invention to those skilled in the art. In the drawings, the sizes of components may be exaggerated for clarity.

It will be understood that when an element or layer is referred to as being "on", "connected to", or "coupled to" another element or layer, it can be directly on, connected to, or coupled to the other element or layer or intervening elements or layers that may be present. In contrast, when an element is referred to as being "directly on", "directly connected to", or "directly coupled to" another element or layer, there are no intervening elements or layers present. As used herein, the term "and/or" includes any and all combinations of one or more of the associated listed items.

It will be understood that, although the terms first, second, etc. may be used herein to describe various elements, components, regions, layers, and/or sections, these elements, components, regions, layers, and/or sections should not be limited by these terms. These terms are only used to distinguish one element, component, region, layer, and/or section from another element, component, region, layer, and/or section. Thus, a first element, component, region, layer, or section discussed below could be termed a second element, component, region, layer, or section without departing from the teachings of example embodiments of inventive concepts.

The terminology used herein is for the purpose of describing particular embodiments only and is not intended to be limiting of example embodiments of inventive concepts. As used herein, the singular forms "a," "an" and "the" are intended to include the plural forms as well, unless the context clearly indicates otherwise. It will be further understood that the terms "comprises", "comprising", "includes" and/or "including," if used herein, specify the presence of stated features, integers, steps, operations, elements and/or components, but do not preclude the presence or addition of one or more other features, integers, steps, operations, elements, components and/or groups thereof.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Example embodiments of inventive concepts described herein will refer to plan views and/or cross-sectional views by way of ideal schematic views. Accordingly, the views may be modified depending on manufacturing technologies and/or tolerances. Therefore, example embodiments of inventive concepts are not limited to those shown in the views, but include modifications in configuration formed on the basis of manufacturing processes. Therefore, regions exemplified in figures have schematic properties and shapes of regions shown in figures exemplify specific shapes or regions of elements, and do not limit example embodiments of inventive concepts.

Reference will now be made in detail to example embodiments of inventive concepts, examples of which are illustrated in the accompanying drawings, wherein like reference numerals refer to the like elements throughout and the size of each element may be exaggerated for clarity and convenience of explanation.

FIG. 1 is a schematic cross-sectional view of a lamp cover 20 for a light emitting device according to example embodiments of inventive concepts. As shown in FIG. 1, the lamp cover 20 may include an outer surface 1 of the lamp cover 20, a supporting transparent cap structure 21 providing an inner surface 2 of the lamp cover 20, a phosphor mixed structure 22 mechanically supported by an outer surface 3 of the supporting transparent cap structure 21, and a light-partial-reflective cap structure 10 disposed between the outer surface 1 and the phosphor mixed structure 22.

The light-partial-reflective cap structure 10 may include two transparent material layers 11 and 13, and two space layers 12 and 14, which are stacked in an alternating manner from outside to inside by the order of number, that is (11-12-13-14). The light-partial-reflective cap structure 10 may also include a first interface 5 between a first space layer 14 and a first transparent material layer 13, a second interface 6 between the first transparent material layer 13 and a second space layer 12, and a third interface 7 between the second space layer 12 and a second transparent material layer 11.

The phosphor mixed structure 22 is adjacent to a first space layer 14 by a surface 4 of the phosphor mixed structure 22. The phosphor mixed structure 22 can be a transparent silicone resin mixed with phosphor. When excited by UV or blue light, the phosphor emits fluorescent light. If the wavelength of exciting light is UV, the fluorescent light can have blue, green, and red or blue and yellow colors to be mixed for white light. If the wavelength of exciting light is blue, the fluorescent light can have yellow color or green and red colors. When mixed with the residual blue light, the fluorescent light can be viewed as a white light. It is preferable that the thickness of the phosphor mixed structure (22) is the same at all positions to achieve a uniform color distribution of white light at all viewing angles.

Although FIG. 1 shows two pairs of transparent material layers and space layers, it can be one or any integer number larger than two. The first, most inner space layer 14 may be a vacuum so that the first space layer 14 protects the phosphor mixed structure 22 by preventing it from being exposed and oxidized in the air. However, except the first space layer 14, the other space layer 12 can be an air-filled layer. The first and second transparent material layers 13 and 11 may made of, for example, a PPA (polyphthalamide) plastic.

Figure 2A:
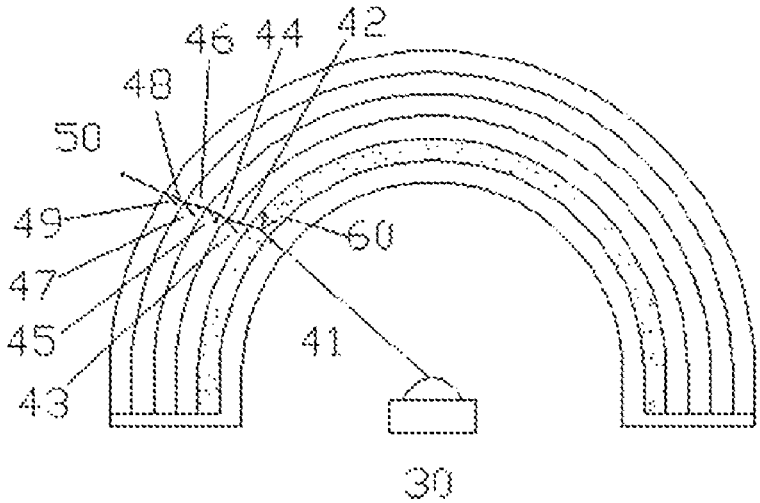
FIG. 2A is a schematic cross-sectional view of a light emitting device utilizing the lamp cover of FIG. 1.

FIG. 2A is a schematic cross-sectional view of a light emitting device 70 utilizing the lamp cover 20 of FIG. 1. Referring to FIG. 2A, the light emitting device 70 may comprise a substrate 31, a LED package 30 mounted on the substrate 31, and the lamp cover 20 which is disposed on the substrate 31 to surround the LED package 30. The substrate 31 may be a printed circuit board (PCB). The light emitting device 70 may be a white light emitting device.

Figure 2B:
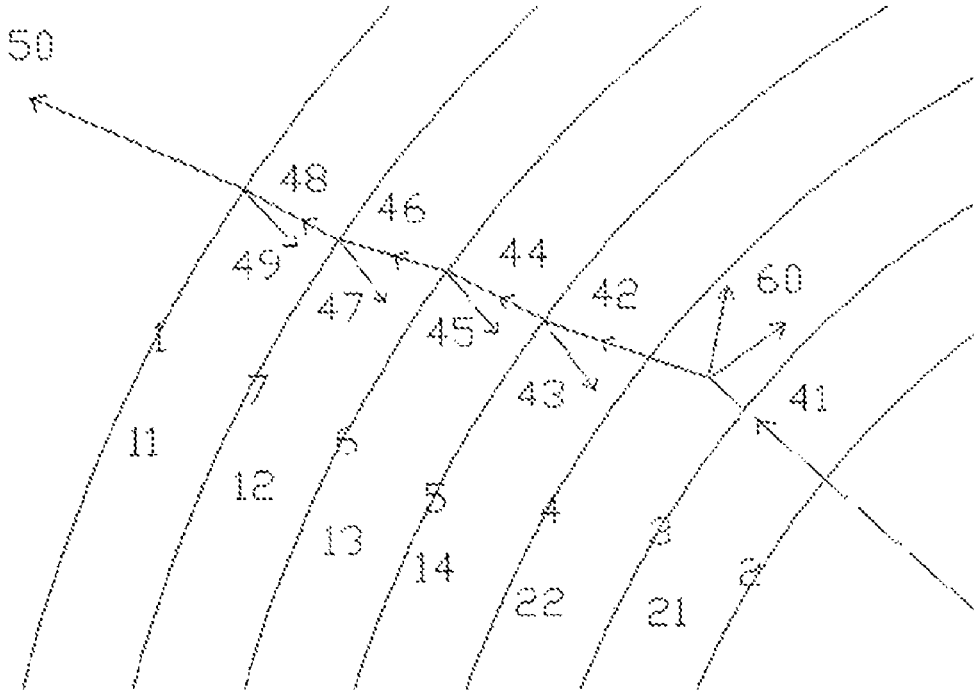

FIGS. 2A and 2B show the mechanism how the lamp cover 20 works with the LED package 30. Although the LED package 30 may emit a blue light ray or emit an UV light ray, for explanatory purposes, it will be assumed hereafter that the LED package 30 emits the blue light ray. First, the blue light ray 41 is emitted from the blue LED package (30). Then, the blue light ray 41 hits the phosphor mixed structure 22 and is at least partially absorbed to emit fluorescent light with a longer wavelength, such as represented by rays 60. The residual blue light ray 42 will keep going into the light-partial-reflective cap structure 10. At the first interface 5 between the first transparent material layer 13 and the first space layer 14, the blue light ray is split into a reflected ray 43 and a transmitted ray 44 by Fresnel reflection and refraction laws, respectively. The residual transmitted ray 44 will keep going and hit the second interface 6 between the first transparent material layer 13 and the second space layer 12, again it will be split into a reflected ray 45 and a transmitted ray 46. The phenomenon is the same for the transmitted blue light ray 46 when it hits the third interface 7 to get a reflected ray 47 and a transmitted ray (48), and the transmitted ray 48 to get a reflected ray 49 and a transmitted ray 50 at the outer surface 1.

The last transmitted ray 50 is the residual blue light to be mixed with the transmitted fluorescent light 43 to achieve white light perception, while the reflected blue light rays 43, 45, 47 and 49 will hit back into the phosphor mixed structure 22 to be reused. Therefore, less phosphor amount may be used to achieve the same correlated color temperature (CCT) than the related art. The phosphor reduction ratio strongly depends on the number of pairs of the transparent material layers and space layers used for the light-partial-reflection cap structure 10. According to an example experiment by using the same amount of phosphor, the method using one pair of the transparent material layers and space layers achieves a CCT 5700K compared to a CCT~6500K without using any pair of the transparent material layers and space layers. The CCT can be dropped up to about 800K. Professional designers know that the data may vary a lot as different transparent materials, such as in refractive indexes, are used for the light-partial-reflective cap structure 10.

It is noted that the fluorescent light rays 60 can also be reflected back into the phosphor mixed structure 22 when they are transmitted through the light-partial-reflective cap structure 10. However, the absorption coefficient of the phosphor mixed structure 22 to the reflected fluorescent light is much less than that to the reflected blue light, because the wavelength of the fluorescent light is longer than that of the blue right. Therefore, the light loss of the reflected fluorescent light is negligible if the number of pairs of the transparent material layers and space layers used for the light-partial-reflection cap structure 10 is not large. When it is required to consider the light loss caused by the Fresnel reflection of the fluorescent light inside the light-partial-reflection cap structure 10, for example, an anti-reflection layer for fluorescent light can be coated at each interface between each pair of the transparent material layers and space layers adjacent to each other in order to prevent the fluorescent light from being reflected back into the phosphor mixed structure 22, while each interface still produces Fresnel reflection for blue light.

What is claimed is:

1. A lamp cover for a light emitting device, comprising:
an outer surface of the lamp cover;
a supporting transparent inner cap;
a phosphor mixed structure adhered to the supporting transparent inner cap, the phosphor mixed structure being disposed between the outer surface and the supporting transparent inner cap of the lamp cover; and
a light-partial-reflective cap structure disposed between the outer surface and the phosphor mixed structure,
wherein the light-partial-reflective cap structure comprises at least two light transparent material layers and at least two space layers that are stacked in an alternating manner,
wherein the supporting transparent inner cap comprises a central portion that is a concavely curved plate, and a peripheral portion that is a flat plate, and
wherein the peripheral portion of the supporting transparent inner cap is folded to an outer direction of the lamp cover such that the peripheral portion of the supporting transparent inner cap directly contacts with ends of the phosphor mixed structure and ends of the light-partial-reflective cap structure.

2. The lamp cover according to claim 1, wherein at least two interfaces between the at least two transparent material layers and the at least two space layers serves as a light-partial-reflective surface by using Fresnel reflection.

3. The lamp cover according to claim 2, wherein the at least two interfaces are coated with an anti-reflection layer for fluorescent light emitting from the phosphor mixed structure to prevent the fluorescent light from being reflected back into the phosphor mixed structure.

4. The lamp cover according to claim 1, wherein an outer surface of the phosphor mixed structure is adjacent to the most inner space layer of the light-partial-reflective cap structure.

5. The lamp cover according to claim 1, wherein the most inner space layer of the light-partial-reflective cap structure is a vacuum in order to protect the phosphor mixed structure by preventing it from being oxidized, and the other space layers are air-filled layers when the light-partial-reflective cap structure comprises a plurality of the space layers.

6. A light emitting device, comprising:
a substrate;
a LED package mounted on the substrate; and
a lamp cover disposed on the substrate to surround the LED package,
wherein the lamp cover comprises:
an outer surface of the lamp cover;
a supporting transparent inner cap; a phosphor mixed structure adhered to the supporting transparent inner cap, the phosphor mixed structure being disposed between the outer surface and the supporting transparent inner cap of the lamp cover and
a light-partial-reflective cap structure disposed between the outer surface and the phosphor mixed structure,
wherein the light-partial-reflective cap structure comprises at least two light transparent material layer and at least two space layers that are stacked in an alternating manner,
wherein the supporting transparent inner cap comprises a central portion that is a concavely curved plate, and a peripheral portion that is a flat plate, and
wherein the peripheral portion of the supporting transparent inner cap is folded to an outer direction of the lamp cover such that the peripheral portion of the supporting transparent inner cap directly contacts with ends of the phosphor mixed structure and ends of the light-partial-reflective cap structure.

7. The light emitting device according to claim 6, wherein at least two interfaces between the at least two transparent material layers and the at least two space layers serves as a light-partial-reflective surface by using Fresnel reflection.

8. The light emitting device according to claim 7, wherein the at least two interfaces are coated with an anti-reflection layer for fluorescent light emitting from the phosphor mixed structure to prevent the fluorescent light from being reflected back into the phosphor mixed structure.

9. The light emitting device according to claim 6, wherein an outer surface of the phosphor mixed structure is adjacent to the most inner space layer of the light-partial -reflective cap structure.

10. The light emitting device according to claim 6, wherein the most inner space layer of the light-partial-reflective cap structure is a vacuum in order to protect the phosphor mixed structure by preventing it from being oxidized, and the other space layers are air-filled layers when the light-partial-reflective cap structure comprises a plurality of the space layers.

11. The light emitting device according to claim 6, wherein the LED package emits a blue light ray or an UV light ray.

12. The light emitting device according to claim 6, wherein the substrate is a PCB.

13. A lamp cover for a light emitting device, comprising:
an outer surface of the lamp cover;
a supporting transparent cap structure providing an inner surface of the lamp cover;

a phosphor mixed structure supported by the supporting transparent cap structure; and a light-partial-reflective cap structure disposed between the outer surface and the phosphor mixed structure, wherein the light-partial-reflective cap structure comprises at least one light transparent material layer and at least one space layer that are stacked in an alternating manner, wherein the supporting transparent cap structure comprises a central portion that is a concavely curved plate, and a peripheral portion that is a flat plate, and wherein the peripheral portion of the supporting transparent cap structure is folded to an outer direction of the lamp cover such that the peripheral portion of the supporting transparent cap structure directly contacts with ends of the phosphor mixed structure and ends of the light-partial-reflective cap structure.

14. A light emitting device, comprising:

a substrate;

a LED package mounted on the substrate; and a lamp cover disposed on the substrate to surround the LED package, wherein the lamp cover comprises:

an outer surface of the lamp cover;

a supporting transparent cap structure providing an inner surface of the lamp cover;

a phosphor mixed structure supported by the supporting transparent cap structure; and a light-partial-reflective cap structure disposed between the outer surface and the phosphor mixed structure, wherein the light-partial-reflective cap structure comprises at least one light transparent material layer and at least one space layer that are stacked in an alternating manner, wherein the supporting transparent cap structure comprises a central portion that is a concavely curved plate, and a peripheral portion that is a flat plate, and wherein the peripheral portion of the supporting transparent cap structure is folded to an outer direction of the lamp cover such that the peripheral portion of the supporting transparent cap structure directly contacts with ends of the phosphor mixed structure and ends of the light-partial-reflective cap structure.

* * * * *